United States Patent [19]

Leonard

[11] Patent Number: 4,652,176

[45] Date of Patent: Mar. 24, 1987

[54] VIBRATORY PLOW WITH BLADE HAVING REGRESSIVE LONGITUDINAL AXIS

[75] Inventor: Emil T. Leonard, Wichita, Kans.

[73] Assignee: J. I. Case Company, Racine, Wis.

[21] Appl. No.: 713,929

[22] Filed: Mar. 20, 1985

[51] Int. Cl.[4] ..... E02F 5/18

[52] U.S. Cl. ..... 405/182; 405/183; 172/40; 172/699; 37/193

[58] Field of Search ..... 172/40, 699, 700; 37/193; 405/180, 181, 182, 183

[56] References Cited

U.S. PATENT DOCUMENTS

| | | | |
|---|---|---|---|
| 1,513,937 | 11/1924 | Seidler | 405/181 |
| 3,111,007 | 11/1963 | Ryan | 405/183 |
| 3,326,010 | 6/1967 | Gagne | 405/182 |

FOREIGN PATENT DOCUMENTS

| | | | |
|---|---|---|---|
| 432824 | 8/1926 | Fed. Rep. of Germany | 37/193 |
| 2806379 | 8/1978 | Fed. Rep. of Germany | 405/180 |
| 272411 | 9/1970 | U.S.S.R. | 405/183 |
| 441626 | 12/1974 | U.S.S.R. | 37/193 |

*Primary Examiner*—Richard T. Stouffer

*Attorney, Agent, or Firm*—Cullen, Sloman, Cantor, Grauer, Scott & Rutherford

[57] ABSTRACT

A vibratory plow blade having a tapered leading edge, a trailing edge, and a tapered bottom edge wherein the plow blade is configured such that its longitudinal axis regresses or is arcuately angled away from the towing vehicle. The tapered leading edge of the plow blade includes an upper straight cutting section and a plurality of forward angled serrations along its length which provide for downward and upward cutting and fracturing of the soil with each successive stroke of the blade during vibratory action. The guide chute for the cable is mounted to the trailing edge at a substantial bend radius for reducing the flexing required of the cable and reducing the weight of the guide chute. The construction permits close proximity between the plow blade and guide chute for providing increased chute protection and a reduction in the chute frictional drag thereby leaving more vibrational energy for soil displacement.

1 Claim, 4 Drawing Figures

VIBRATORY PLOW WITH BLADE HAVING REGRESSIVE LONGITUDINAL AXIS

BACKGROUND OF THE INVENTION

The present invention relates generally to a vibratory plow assembly which is adapted to lay cable, flexible pipe and the like underground in the cut made by a blade wherein the blade is vibrated to reduce the force required to pull the blade through the ground. More particularly, the present invention relates to a plow blade construction which provides for improved vibratory plowing.

Vibratory cable plows have been used for several years to lay cable, flexible pipe and the like underground. The cable or pipe may be either pulled through the cut of the plow blade or a cable chute may be provided on the trailing edge of the plow blade which guides the cable or pipe into the ground from a drum mounted on the tractor or other vehicle. Various types of vibrators have been mounted on the plow blade, or the vibrator and blade have been suspended together on a resilient frame assembly to generate either vertical or orbital motion in the plow blade. Examples of such prior art vibratory plows are disclosed in U.S. Pat. Nos. 4,040,261, 3,618,237 and 3,363,423, all assigned to the assignee of the present application.

Prior vibratory plow blades are generally straight in configuration and are inserted in the ground at a slight forward angle to create a downward reaction force to prevent rising of the blade as it is pulled through the ground. Alternatively, the blade may have a slight forward bend as its lowermost point for providing additional downward reaction force. However, this construction presents a problem in that the attached cable guide chute directs the cable in an opposite direction which places the cable at a substantial bend angle at the bottom of the blade cut due to the forward angle of the blade. Thus, there has been a need for a construction which requires less bend angle of the cable and reduces chute frictional drag.

While vibration of the plow blade of a cable laying plow results in several advantages including less ground disturbance and faster cable laying installation, it has now been discovered that the plow blade may be constructed in a way that adds to the efficiency of the vibratory plowing action. In particular, a plow blade constructed in accordance with the teachings of the present invention will substantially reduce the force required to cut the earth and pull the blade through the ground.

SUMMARY OF THE INVENTION

The vibratory plow blade of the present invention includes a lead or ground slitting edge which is tapered to reduce drag and wear while still providing the necessary strength required. A cable guide is supported on the rear edge of the blade for receiving a cable which is continuously fed into and along the bottom of a ground slit formed by the blade. The blade is fixedly supported to a shaker frame having a power driven oscillating mechanism supported thereon for reciprocating the blade vertically between upper and lower limits. The blade, shaker frame and oscillating mechanism are suspended on a vehicle such as a conventional tractor.

The plow blade of the present invention is constructed along its leading edge and bottom edge to provide for improved vibratory plowing. In particular, the tapered leading edge of the plow blade includes an upper straight cutting section and a plurality of forward angled saw-like teeth or serrations along its length. The plow blade is configured such that when it is at the correct soil depth, its longitudinal axis regresses or is arcuately angled away from the axis or the mast assembly to which it is mounted.

The upper straight cutting section acts as a soil or sod cutter as the plow blade moves along the ground slot formed by the blade during vibration. The forward angled serrations provide for the downward reaction force that is necessary to prevent blade rise. Further, these serrations provide for downward and upward cutting and fracturing of the soil with each successive stroke of the blade from the vibratory action. This reduces the amount of work required to move the plow blade through the soil in the direction of plowing and relieves surface tension created by packed soil or sod.

Since the axis of the plow blade regresses arcuately away from the towing vehicle, the guide chute for the cable assumes a much greater bend radius than was possible in prior constructions. This substantially reduces the flexing required of the cable and reduces the weight of the guide chute. Further, the construction permits a close proximity between the plow blade and guide chute which provides for increased chute protection and reduction in chute frictional drag, thereby leaving more vibrational energy for soil displacement.

Other advantages and meritorious features of the vibratory plow blade of the present invention will be more fully understood from the following description of the invention, the appended claims and the drawings, a brief description of which follows.

DETAILED DESCRIPTION OF THE INVENTION

Figure 1:
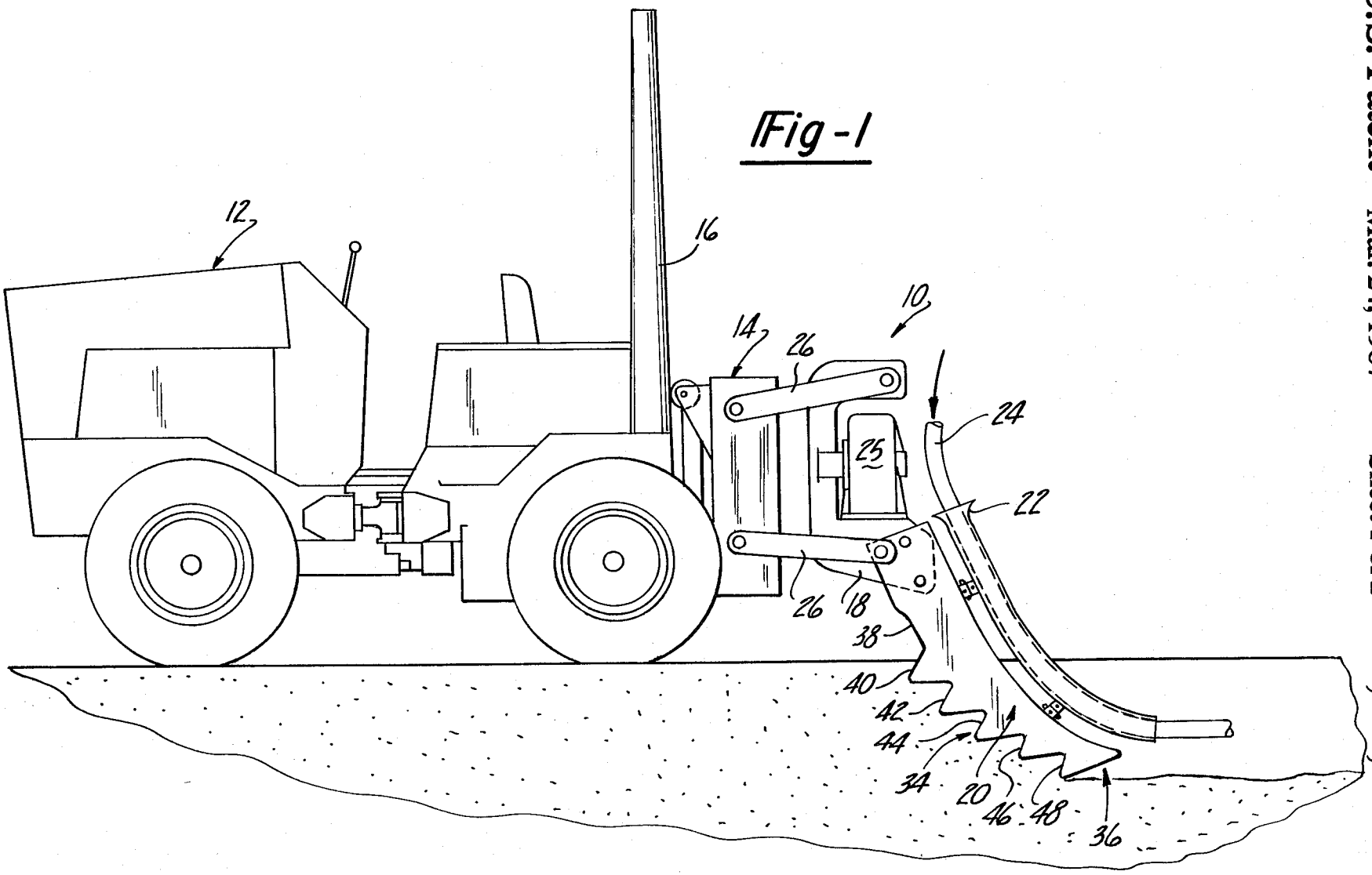
FIG. 1 is a side elevational view of a tractor and vibratory cable laying plow having the plow blade of the present invention.

Referring to FIG. 1, a vibratory plow assembly 10 is connected to the rear of vehicle 12, which may be a tractor, bulldozer or the like. Generally, the vibratory plow assembly 10 includes a vertical mast assembly 14 which is attached to vehicle rear frame portion 16, a vertical shaker frame 18, and a plow blade 20, made in accordance with the present invention. Blade 20 has a cable guide 22 supported thereon for receiving a cable 24 which is continuously fed into and along the bottom of the ground slot formed by blade 20, as is conventional.

The upper end of blade 20 is fixedly supported to the generally C-shaped shaker frame 18. Shaker frame 8 has a power driven oscillating mechanism 25 supported thereon for reciprocating blade 20 vertically between upper and lower limits. Blade 20, cable guide 22, shaker frame 18 and oscillating mechanism 25 are suspended from mast assembly 14 by upper and lower pairs of connecting links 26. As is conventional, the oscillating mechanism 25 is adapted to vibrate blade 20 and thereby transmit an arcuate or orbital motion to the blade.

Figure 2:
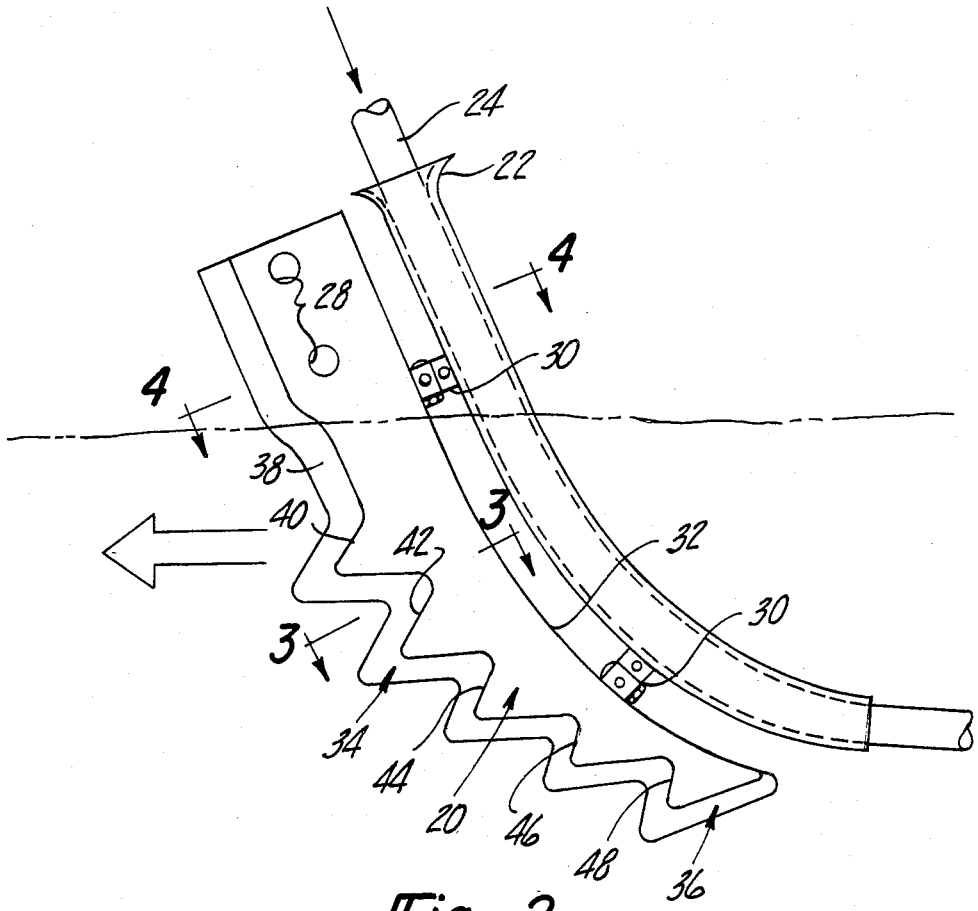
FIG. 2 is a side elevational view of the vibratory plow blade of the present invention.
Figure 3:
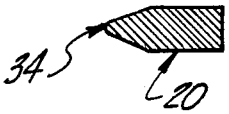
FIG. 3 is a cross-sectional view taken along line 3—3 in FIG. 2.
Figure 4:
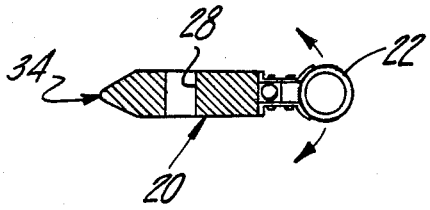
FIG. 4 is a cross-sectional view taken along line 4—4 in FIG. 2.

Referring now to FIGS. 2–4, the plow blade 20 of the present invention is shown in greater detail. The upper end of plow blade 20 includes openings 28 for permitting the attachment of blade 20 to shaker frame 18. Further, brackets 30 are provided on the rear or trailing edge 32 of blade 20 for permitting cable chute 22 to be attached thereto. The present invention, however, relates to the construction of plow blade 20 along its tapered leading edge 34 and tapered bottom edge 36, which provides for improved vibratory plowing.

In particular, the tapered leading edge 34 of plow blade 20 includes an upper straight cutting section 38 and a plurality of forward angled saw-like teeth or serrations generally 40, 42, 44, 46 and 48. Plow blade 20 is configured such that when it is at the correct soil depth as shown in FIG. 2, its longitudinal axis regresses or is angled arcuately away from the axis of mast assembly 14.

The upper straight cutting section 38 acts as a soil or sod cutter as plow blade 20 moves along the ground slot formed by the blade during vibration. That is, after the plow blade is positioned into the soil as generally shown in FIG. 2, the upper section 38 provides a cut in the soil with each successive downstroke from the vibratory action thereby relieving surface tension created by packed soil or sod.

The forward angled serrations 40, 42, 44, 46 and 48 provide for the downward reaction force that is necessary to prevent blade rise. These serrations provide for downward and upward cutting and fracturing of the soil with each successive stroke of the blade from the vibratory action. This reduces the amount of work required to move the plow blade through the soil in the direction of plowing. Finally, the bottom edge 36 of plow blade 20 is tapered to reduce soil resistance that is created as the plow blade 20 is returned to the lowest point in the stroke during vibratory motion.

Since the axis of plow blade 20 regresses arcuately away from towing vehicle 12, the guide chute 22 for cable 24 assumes a much greater bend radius than was possible in prior constructions. This substantially reduces the flexing required of the cable and reduces the weight of the guide chute. Further, the construction permits a close proximity between the plow blade 20 and chute 22 and provides increased chute protection and reduces chute frictional drag thereby leaving more vibrational energy for soil displacement.

It will be apparent to those skilled in the art that the foregoing disclosure is exemplary in nature rather than limiting, the invention being limited only by the appended claims.

I claim:

1. In a vibratory plow for laying cable, pipe and the like underground including a prime mover, an elongated plow blade mounted at an upper end to a generally C-shaped blade shaker support frame, said blade support frame having a vibrator mounted within said C-shaped frame for transmitting orbital motion to said plow blade for forming a ground slot, and said blade support frame pivotally mounted by upper and lower pairs of connecting links to a vertical mast assembly on said prime mover, the improvement comprising:

said plow blade having a leading edge, a trailing edge and a bottom edge, said leading edge being tapered and including an upper straight cutting section which acts as a soil cutter with each successive downstroke from the orbital motion thereby relieving surface tension created by packed soil, and said plow blade including a plurality of forward angled serrations along its lenth for providing a downward reaction force for preventing blade rise and providing cutting and fracturing of soil with each successive stroke of the blade from the orbital motion, and said plow blade being configured such that its longitudinal axis is regressive and angled arcuately away from the axis of said mast assembly, a cable guide chute mounted to the trailing edge of said plow blade and said guide chute having a substantial bend radius due to the regressive angling of said plow blade for reducing the flexing required of a cable inserted through said guide chute, and wherein the bottom edge of said plow blade being tapered for reducing soil resistance as the plow blade is returned to its lowest point during the orbital motion.

* * * * *